United States Patent [19]

Bloom et al.

[11] Patent Number: 4,887,009

[45] Date of Patent: Dec. 12, 1989

[54] COLOR DISPLAY SYSTEM

[75] Inventors: Stanley Bloom, Bridgewater Township, Somerset County; Eric F. Hockings, Princeton, both of N.J.

[73] Assignee: RCA Licensing Corporation, Princeton, N.J.

[21] Appl. No.: 828,523

[22] Filed: Feb. 12, 1986

[51] Int. Cl.[4] ..... G09G 1/04

[52] U.S. Cl. ..... 315/368; 315/382; 313/414

[58] Field of Search ..... 315/368, 382, 3; 313/432, 435, 412, 414

[56] References Cited

U.S. PATENT DOCUMENTS

| | | | |
|---|---|---|---|
| 2,884,559 | 4/1959 | Cooper, Jr. et al. | 315/14 |
| 3,317,769 | 5/1967 | Johnson | 313/80 |
| 3,397,341 | 8/1968 | Guyot et al. | 313/432 |
| 3,497,744 | 2/1970 | Himmelbaur et al. | 313/432 |
| 3,678,316 | 7/1972 | Barten | 313/69 C |
| 3,678,320 | 7/1972 | Barten | 313/70 C |
| 3,949,262 | 4/1976 | Ohkoshi et al. | 313/412 |
| 3,961,223 | 6/1976 | Ray et al. | 315/371 |
| 4,172,309 | 10/1979 | Chiodi | 315/368 |
| 4,214,188 | 7/1980 | Bafaro et al. | 315/382 |
| 4,234,814 | 11/1980 | Chen et al. | 313/412 |
| 4,258,298 | 3/1981 | Hilburn et al. | 315/382 |
| 4,316,128 | 2/1982 | Shiratsuchi | 315/411 |
| 4,319,163 | 3/1982 | Chen | 315/14 |
| 4,366,419 | 12/1982 | Barten | 315/382 |

FOREIGN PATENT DOCUMENTS

| | | |
|---|---|---|
| 0163443 | 12/1985 | European Pat. Off. . |
| 59-175544 | 10/1984 | Japan . |
| 1567807 | 6/1980 | United Kingdom . |

*Primary Examiner*—Benedict V. Safourek
*Assistant Examiner*—T. Salindong
*Attorney, Agent, or Firm*—Joseph S. Tripoli; Dennis H. Irlbeck

[57] ABSTRACT

A color display system includes a cathode-ray tube and yoke. The yoke is a self-converging type that produces an astigmatic magnetic deflection field within the tube. The cathode-ray tube has an electron gun for generating and directing three electron beams along paths toward a screen of the tube. The electron gun includes electrodes that comprise a beam-forming region and electrodes that form a main focusing lens, and features electrodes for forming a multipole lens between the beam-forming region and the main focusing lens in each of the electron beam paths. Each multipole lens is oriented to provide a correction to an associated electron beam to at least partially compensate for the effect of the astigmatic magnetic field on the associated beam. There are two multipole lens electrodes. A first multipole lens electrode is connected to a main focusing lens electrode, and a second multipole lens electrode is located between the first multipole lens electrode and the beam-forming region and facing the first multipole lens electrode.

15 Claims, 6 Drawing Sheets

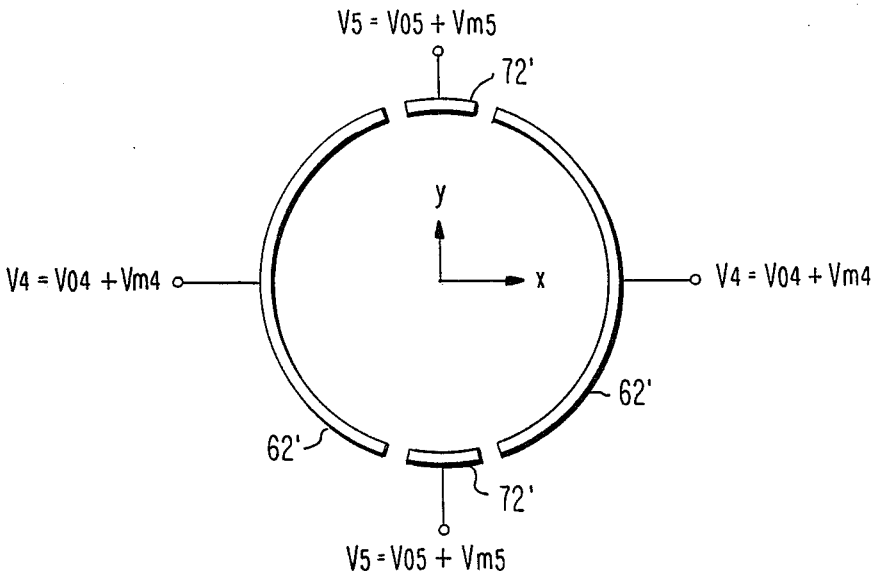
Fig.8
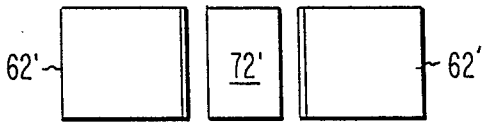
Fig.9
Fig.10
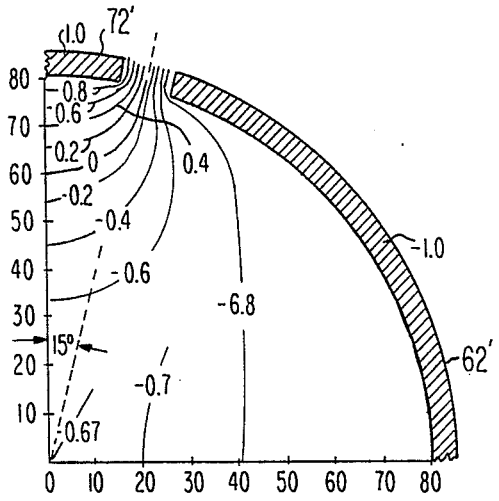

COLOR DISPLAY SYSTEM

The present invention relates to color display systems including cathode-ray tubes having inline electron guns, and particularly to such guns having means therein to compensate for astigmatism of a self-converging deflection yoke used with the tube in the system.

BACKGROUND OF THE INVENTION

Although present-day deflection yokes produce a self-convergence of the three beams in a cathode-ray tube, the price paid for such self-convergence is a deterioration of the individual electron beam spot shapes. The yoke magnetic field is astigmatic, and it both overfocuses the vertical-plane electron beam rays, leading to deflected spots with appreciable vertical flare, and underfocuses the horizontal rays, leading to slightly enlarged spot width. To compensate, it has been the practice to introduce an astigmatism into the beam-forming region of the electron gun to produce a defocusing of the vertical rays and a focusing of the horizontal rays. Such astigmatic beam-forming regions have been constructed by means of G1 control grids or G2 screen grids having slot-shaped apertures. These slot-shaped apertures produce non-axially-symmetric fields with quadrupolar components which act differently upon rays in the vertical and horizontal planes. Such slot-shaped apertures are shown in U.S. Pat. No. 4,234,814, issued to Chen et al. on Nov. 18, 1980. These constructions are static; the quadrupole field produces the same compensatory astigmatism even when the beams are undeflected and experiencing no yoke astigmatism.

To provide improved correction, U.S. Pat. No. 4,319,163, issued to Chen on Mar. 9, 1982, introduced an extra upstream screen grid, G2*a*, with horizontally slotted apertures, and with a variable or modulated potential applied to it. The downstream screen grid, G2*b*, has round apertures and is at a fixed potential. The variable voltage on G2*a* varies the strength of the quadrupole field, so that the astigmatism produced is proportional to the scanned off-axis position.

Although effective, use of astigmatic beam-forming regions has several disadvantages. First, beam-forming regions have a high sensitivity to construction tolerances because of the small dimensions involved. Second, the effective length or thickness of the G2 grid must be changed from the optimum value it has in the absence of slotted apertures. Third, beam current may vary with a variable potential applied to a beam-forming region grid Fourth, the effectiveness of the quadrupole field varies with the position of the beam crossover and, therefore, with beam current. Therefore, it is desirable to develop astigmatism correction in an electron gun which is not subject to all these disadvantages.

SUMMARY OF THE INVENTION

A color display system includes a cathode-ray tube and yoke. The yoke is a self-converging type that produces an astigmatic magnetic deflection field within the tube. The cathode-ray tube has an electron gun for generating and directing three electron beams along paths toward a screen of the tube. The electron gun includes electrodes that comprise a beam-forming region and electrodes that form a main focusing lens and includes electrodes for forming a multipole lens between the beam-forming region and the main focusing lens in each of the electron beam paths. Each multipole lens is oriented to provide a correction to an associated electron beam to at least partially compensate for the effect of the astigmatic magnetic field on the associated beam. There are two multipole lens electrodes. A second of the two multipole lens electrodes is connected to a main focusing lens electrode, and a first of the two multiple electrodes is located between the second multipole lens electrode and the beam-forming region and faces the second multipole lens electrode.

BRIEF DESCRIPTION OF THE DRAWINGS

FIGS. 8 and 9 are front and side views, respectively, of another set of quadrupole lens electrodes.

FIG. 10 is an upper right quadrant view of the quadrupole lens electrodes of FIGS. 8 and 9, showing electrostatic potential lines.

DETAILED DESCRIPTION OF THE PREFERRED EMBODIMENTS

Figure 1:
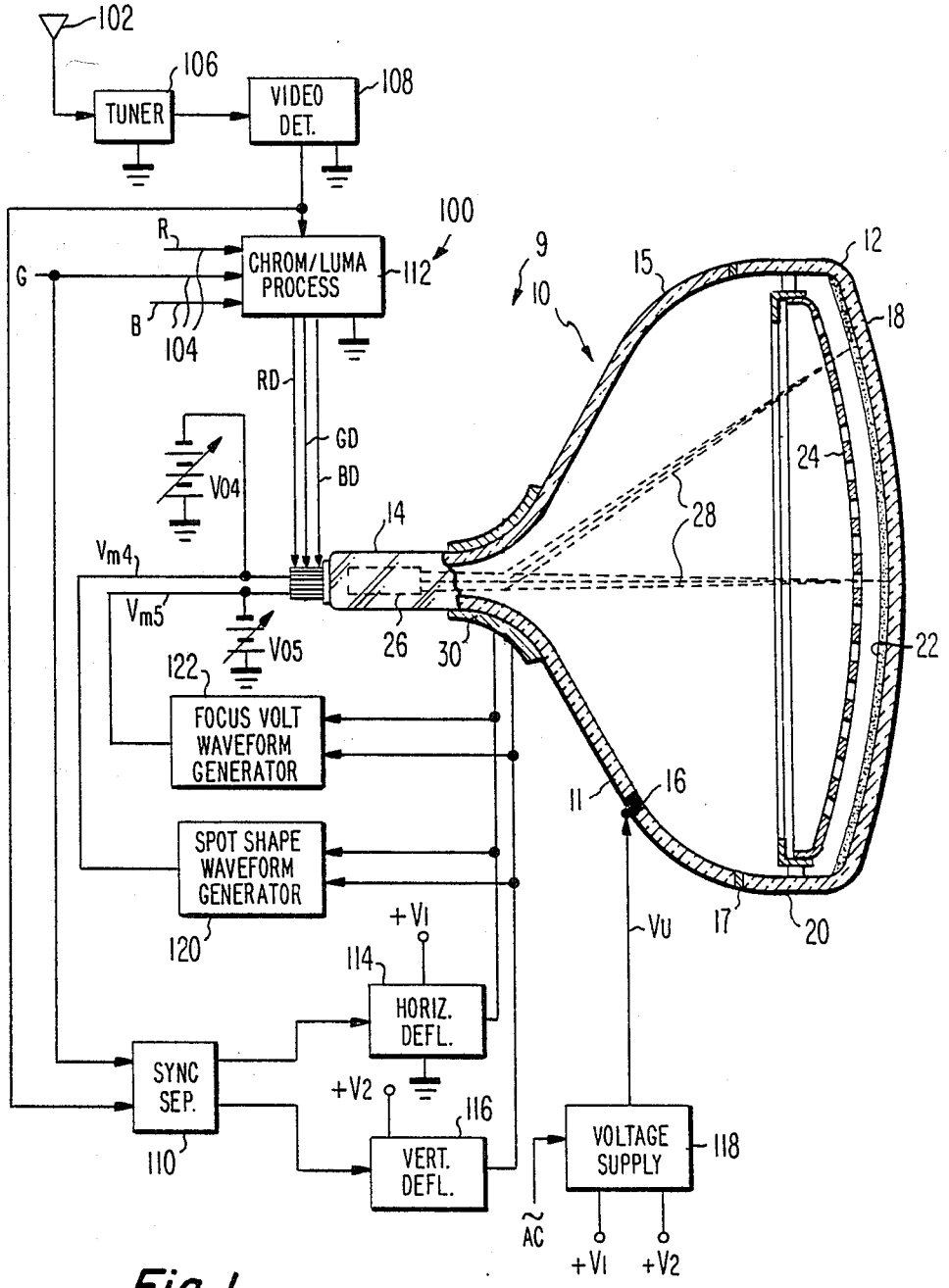
FIG. 1 is a plan view, partly in axial section, of a color display system embodying the invention.

FIG. 1 shows a color display system 9 including a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20 which is sealed to the funnel 15 by a glass frit 17. A three-color phosphor screen 22 is carried by the inner surface of the faceplate 18. The screen 22 preferably is a line screen with the phosphor lines arranged in triads, each triad including a phosphor line of each of the three colors Alternatively, the screen can be a dot screen. A multiapertured color selection electrode or shadow mask 24 is removably mounted, by conventional means, in predetermined spaced relation to the screen 22. An improved electron gun 26, shown schematically by dotted lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvature of the deflection beam paths in the deflection zone is not shown in FIG. 1. In the preferred embodiment, the yoke 30 produces a self-convergence of the three electron beams at the tube screen. Such a yoke forms an astigmatic magnetic field which overfocuses the vertical-plane rays of the beams and underfocuses the horizontal-plane rays of the beams. Compensation for this astigmatism is provided in the improved electron gun 26.

FIG. 1 also shows a portion of the electronics used for exciting the tube 10 and yoke 30. These electronics are described below.

Figure 2:
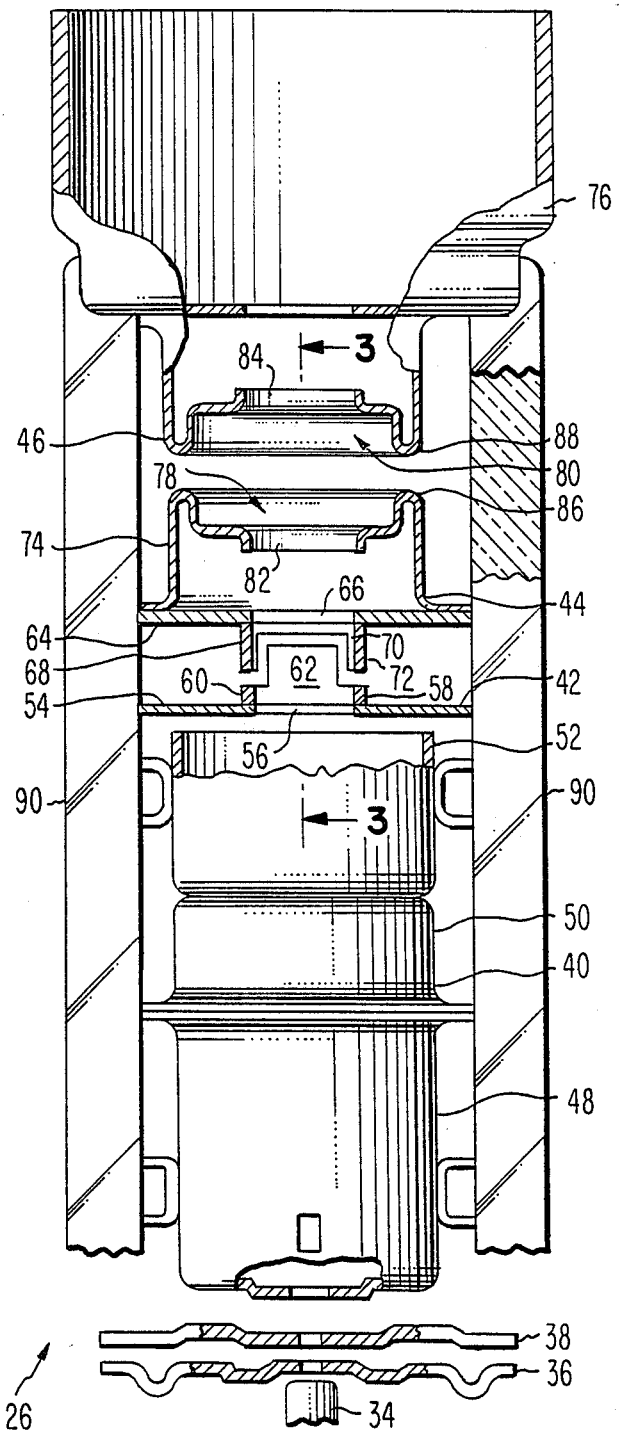
FIG. 2 is a partially cutaway axial section side view of the electron gun shown in dashed lines in FIG. 1.
Figure 3:
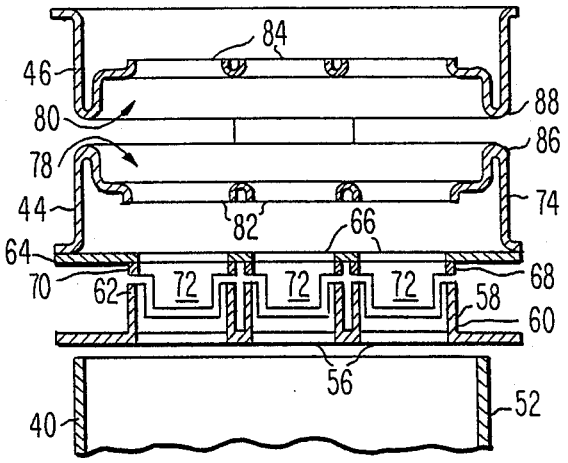
FIG. 3 is an axial section view of the electron gun taken at line 3—3 of FIG. 2.
Figure 4:
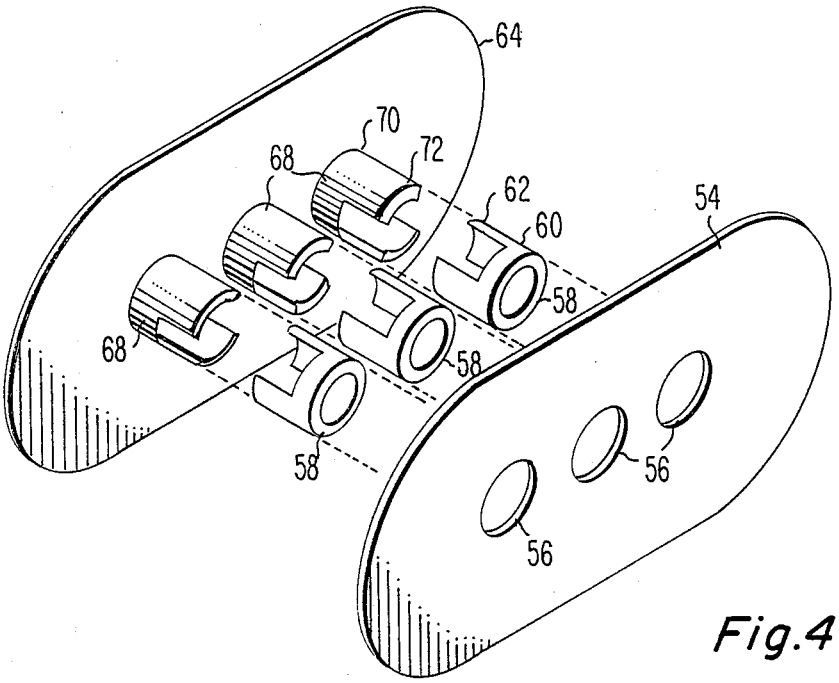
FIG. 4 is a broken-apart perspective view of quadrupole lens electrodes used in the electron gun.

The details of the electron gun 26 are shown in FIGS. 2, 3 and 4. The gun 26 comprises three spaced inline cathodes 34 (one for each beam, only one being shown), a control grid electrode 36 (G1), a screen grid electrode 38 (G2), an accelerating electrode 40 (G3), a first quadrupole electrode 42 (G4), a combined second quadrupole electrode and first main focusing lens electrode 44 (G5), and a second main focusing lens electrode 46 (G6), spaced in the order named. Each of the G1 through G6 electrodes has three inline apertures located therein to permit passage of three electron beams. The electrostatic main focusing lens in the gun 26 is formed by the facing portions of the G5 electrode 44 and the G6 electrode 46. The G3 electrode 40 is formed with three cup-shaped elements 48, 50 and 52. The open ends of two of these elements, 48 and 50, are attached to each other, and the apertured closed end of the third element 52 is attached to the apertured closed end of the second element 50. Although the G3 electrode 40 is shown as a three-piece structure, it could be fabricated from any number of elements to attain the same or any other desired length.

The first quadrupole electrode 42 comprises a flat plate 54 having three inline apertures 56 therein and castled cylinders 58 extending therefrom in alignment with the apertures 56. Each cylinder 58 includes a cylindrical portion 60 in contact with the plate 54 and two sector portions 62 extending from the cylindrical portion 60. The two sector portions 62 are located opposite each other, and each sector portion 62 encompasses approximately 85 degrees of the cylinder circumference.

The portion of the G5 electrode 44 that comprises the second quadrupole lens electrode includes a flat plate 64 having three inline apertures 66 therein and castled cylinders 68 extending therefrom in alignment with the apertures 66. Each cylinder 68 includes a cylindrical portion 70 in contact with the plate 64 and two sector portions 72 extending from the cylindrical portion 70. The two sector portions are located opposite each other, and each sector portion 72 encompasses approximately 85 degrees of the cylinder circumference. The positions of the sector portions 72 are rotated 90° from the positions of the sector portions 62, and the sector portions are assembled in non-touching, interdigitated fashion. Although the sector portions 62 and 72 are shown with square corners, such corners may be rounded.

The portion of the G5 electrode 44 that comprises the first main focusing electrode includes a somewhat cup-shaped element 74 which has its open end closed by the plate 64. The G6 electrode 46 is similar in shape to the element 74, but has its open end closed by an apertured shield cup 76. The facing apertured closed ends of the G5 electrode 44 and the G6 electrode 46 have large recesses 78 and 80, respectively, therein. The recesses 78 and 80 set back a portion of the closed end of the G5 electrode 44 that contains three inline apertures 82 from the portion of the closed end of the G6 electrode 46 that contains three inline apertures 84. The remaining portions of the closed ends of the G5 electrode 44 and the G6 electrode 46 form rims 86 and 88, respectively, that extend peripherally around the recesses 78 and 80. The rims 86 and 88 are the closest portions of the two electrodes 44 and 46 to each other.

All of the electrodes of the gun 26 are either directly or indirectly connected to two insulative support rods 90. The rods 90 may extend to and support the G1 electrode 36 and the G2 electrode 38, or these two electrodes may be attached to the G3 electrode 40 by some other insulative means. In a preferred embodiment, the support rods are of glass, which has been heated and pressed onto claws extending from the electrodes, to embed the claws in the rods.

Figure 5:
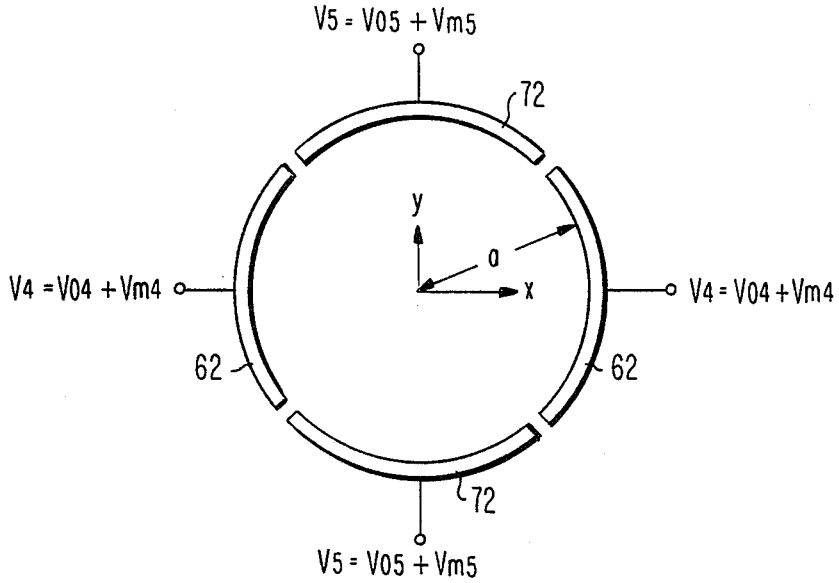
FIGS. 5 and 6 are front and side views, respectively, of a first set of quadrupole lens electrodes.
Figure 6:
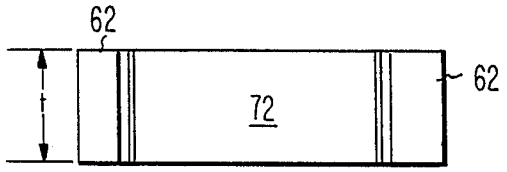

FIGS. 5 and 6 show the sector portions 62 and 72 of the cylinders 58 and 68, respectively. The four sector portions are of equal dimensions, being curved on a radius "a" and having an overlapped length "t". A voltage $V_4=V_{o4}+V_{m4}$ is applied to the sector portions 62, and a voltage $V_5=V_{o5}+V_{m5}$ is applied to the sector portions 72. Subscript "o" indicates a D.C. voltage, and subscript "m" indicates a modulated voltage. This structure produces a quadrupolar potential, $$\phi=(V_4+V_5)/2+(V_4-V_5)(x^2-y^2)/2a^2+\ldots,$$

and a transverse field, $$E_x=-(\Delta V/a^2)x=(-x/y)E_y,$$

where $$\Delta\Delta=V_4-V_5.$$

This field deflects an incoming ray through an angle, $$\theta\simeq LE_x/2V_o,$$

where the effective length of the interaction region is $$L\simeq 0.4a+t,$$

and where the mean potential is $$V_o=(V_4+V_5)/2.$$

Thus, the paraxial focal length of this quadrupole lens is $$f_x=x/\theta\simeq[2a^2/(0.4a+t)](V_o/\Delta V)=-f_y.$$

An additional degree of control is obtainable by using a different lens radius, a, and/or length, t, for the quadrupoles around the two outer beams, as compared to those for the quadrupole around the center beam.

Figure 7:
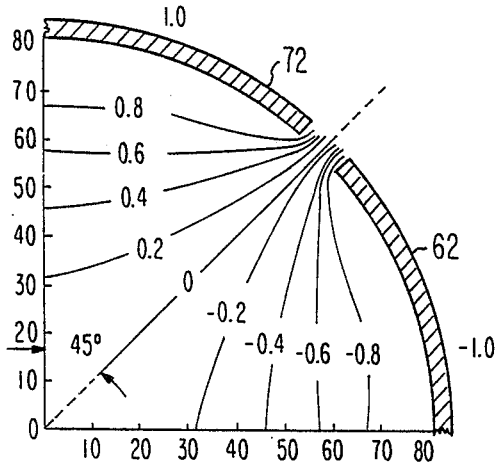
FIG. 7 is an upper right quadrant view of the quadrupole lens electrodes of FIGS. 5 and 6, showing electrostatic potential lines.

The electrostatic potential lines established by the equal sector portions 62 and 72 are shown in FIG. 7 for one quadrant. Nominal voltages of 1.0 and −1.0 are shown applied to the sector portions 72 and 62, respectively. The electrostatic field forms a quadrupole lens which has a net effect on an electron beam of compressing it in one direction and expanding it in an orthogonal direction.

Although the above-described embodiment has been shown having equal quadrant and circular sector portions, noncircular and/or unequal sector portions also can be used to attain other order multipoles. An example is shown in FIGS. 8 and 9. In this example, two sector portions 62' each encompass approximately 145 degrees of the circumference, and two smaller sector portions 72' encompass each approximately 25 degrees of the circumference. The electrostatic field lines formed by these sector portions 62' and 72', with nominal voltages applied, are shown in FIG. 10. The net effect of this electrostatic field is to compress an electron beam more in one direction than to expand it in an orthogonal direction.

Figure 11:
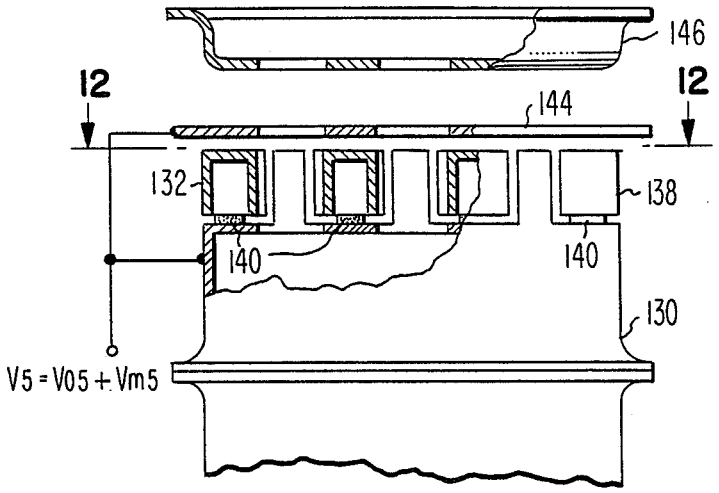
FIG. 11 is a top view, partially in section, of another electron gun.
Figure 12:
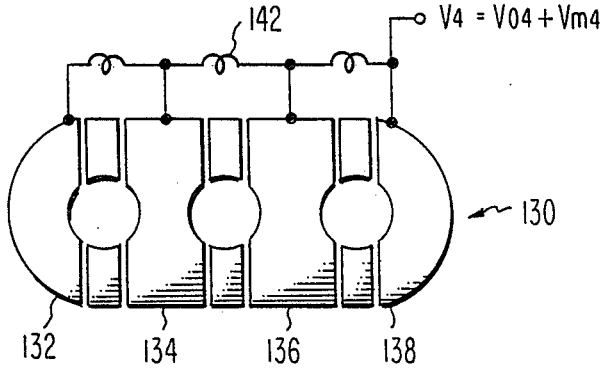
FIG. 12 is a front view of the quadrupole lens electrodes of the electron gun taken at line 12—12 of FIG. 11.

Although the above-described embodiment has been shown with castled interdigitated cylinders used to form a multipole lens, other construction techniques also may be used. FIGS. 11 and 12 show another electron gun embodiment. In this embodiment, a main lens focus electrode 130, having extrusions at its apertures, is sectioned by cutting out four pieces 132, 134, 136 and 138 from a closed end of the electrode. The sectioning is done through the apertures, as shown in FIG. 12, dividing each extrusion into four segments of a cylinder. These four sectioned pieces are then attached back to the main portion of the electrode 130 with an insulative ceramic cement 140 and are electrically interconnected to each other by a fine wire 142. The remaining parts of the electron gun that form the main focusing lens are a buffer plate 144 and a final electrode 146. The buffer plate 144 isolates the main lens from the quadrupole lens, both electrically and physically.

The electron gun 26 includes a dynamic quadrupole lens which is located differently and constructed differently than prior uses of quadrupole lenses in electron guns. The new quadrupole lens includes curved plates having surfaces that lie parallel to the electron beam paths and form electrostatic field lines that are normal to the beam paths. The quadrupole lens is located between the beam-forming region and the main focusing lens, but closer to the main focusing lens. The advantages of this location are: (1) a low sensitivity to construction tolerances, (2) the effective G2 length need not be changed from the optimum value, (3) the closeness of the quadrupole to the main focusing lens produces beam bundles which are closely circular in the main lens and less likely to be intercepted by the main focusing lens, (4) the beam current is not modulated by the variable quadrupole voltage, (5) the effective quadrupole lens strength is greater the closer the quadrupole lens is to the main lens, and (6) the quadrupole lens, being separate from the main focus lens, does not adversely affect the main lens. The advantages of the new construction are: (1) the quadrupole's transverse fields are produced directly and are stronger than the transverse fields which arise indirectly in the prior tube of U.S. Pat. No. 4,319,163, (2) the absence of spherical aberration caused by the higher multipoles produced additionally by the slotted-aperture type of grid lens, and (3) self-containment, making the construction independent of adjacent electrodes.

Referring back to FIG. 1, there is shown a portion of the electronics 100 that may operate the system as a television receiver and as a computer monitor. The electronics 100 is responsive to broadcast signals received via an antenna 102, and to direct red, green and blue (RGB) video signals via input terminals 104. The broadcast signal is applied to tuner and intermediate frequency (IF) circuitry 106, the output of which is applied to a video detector 108. The output of the video detector 108 is a composite video signal that is applied to a synchronizing signal (sync) separator 110 and a chrominance and luminance signal processor 112. The sync separator 110 generates horizontal and vertical synchronizing pulses that are, respectively, applied to horizontal and vertical deflection circuits 114 and 116. The horizontal deflection circuit 114 produces a horizontal deflection current in a horizontal deflection winding of the yoke 30, while the vertical deflection circuit 116 produces a vertical deflection current in a vertical deflection winding of the yoke 30.

In addition to receiving the composite video signal from the video detector 108, the chrominance and luminance signal processing circuit 112 alternatively may receive individual red, green and blue video signals from a computer, via the terminals 104. Synchronizing pulses may be supplied to the sync separator 110 via a separate conductor or, as shown in FIG. 1, associated with the green video signal. The output of the chrominance and luminance processing circuitry 112 comprises the red, green and blue color drive signals, that are applied to the electron gun 26 of the cathode ray tube 10 via conductors RD, GD and BD, respectively.

Power for the system is provided by a voltage supply 118, which is connected to an AC voltage source. The voltage supply 118 produces a regulated DC voltage level $+V_1$ that may, illustratively, be used to power the horizontal deflection circuit 114. The voltage supply 118 also produces DC voltage $+V_2$ that may be used to power the various circuits of the electronics, such as the vertical deflection circuit 116. The voltage supply further produces a high voltage $V_u$, that is applied to ultor terminal or anode button 16.

Circuits and components for the tuner 106, video detector 108, sync separator 110, processor 112, horizontal deflection circuit 114, vertical deflection circuit 116 and voltage supply 118 are well known in the art and, therefore, are not specifically described herein.

In addition to the foregoing elements, the electronics 100 includes either one or two dynamic circuits and a focus voltage waveform generator 122, with or without a spot shape waveform generator 120. The spot shape waveform generator 120 provides the dynamically varied voltage $V_{m4}$ to the sector portions 62 of the electron gun 26. The focus voltage waveform generator 122 is similar in design to the generator 120, but provides a dynamically varied focus voltage $V_{m5}$ to the electrodes 40 and 44. Use of these two generators permits optimization of both electron beam spot focus and spot shape at any point on the tube screen.

Both of the generators 120 and 122 receive the horizontal and vertical scan signals from the horizontal deflection circuit 114 and the vertical deflection circuit 116, respectively. The circuitry for the waveform generators 120 and 122 can be that as is known in the art. Examples of such known circuits may be found in: U.S. Pat. No. 4,214,188, issued to Bafaro et al. on July 22, 1980; U.S. Pat. No. 4,258,298, issued to Hilburn et al. on Mar. 24, 1981; and U.S. Pat. No. 4,316,128, issued to Shiratsuchi on Feb. 16, 1982. These patents are hereby incorporated by reference for their showings of such dynamic circuitry.

Tables I and II give experimental results of the center and corner beam spot sizes for an electron gun, such as gun 26, in a 26V110° color picture tube with a 25 KV ultor voltage applied and a beam current of 2.0 mA. Table I presents the voltages applied to the first quadrupole electrode 42, $V_{G4}$, the combined second quadrupole electrode and first main focusing electrode 44, $V_{G5}$, the voltage difference between these electrodes $\Delta V$ and the horizontal H and vertical V spot sizes, in mils, at the center and corner of the screen when no bias is applied.

TABLE I

| | $V_{G5}$ | $V_{G4}$ | $\Delta V$ | H × V |
|---|---|---|---|---|
| Center | 6550 | 6550 | 0 | 71 × 132 |
| Corner | 6550 | 6550 | 0 | 147 × 86 |

Table II presents similar information but for the situation when a bias is applied.

TABLE II

| | $V_{G5}$ | $V_{G4}$ | $\Delta V$ | H × V |
|---|---|---|---|---|
| Center | 6000 | 5800 | −200 | 61 × 76 |
| Corner | 6750 | 7000 | +250 | 91 × 51 |

As can be seen by comparing the foregoing tables, considerable reduction in the vertical dimension of the electron beam spot is achieved by proper application of voltages to the quadrupole structure.

What is claimed is:

1. In a color display system including a cathode-ray tube having an electron gun for generating and directing three electron beams along paths toward a screen of said tube, said gun including electrodes comprising a beam-forming region and electrodes for forming a main focusing lens, and said system including a self-converging yoke that produces an astigmatic magnetic deflection field, the improvement comprising electrodes in said electron gun for forming a multipole lens between the beam-forming region and the main focusing lens in each of the electron beam paths wherein each multipole lens is oriented to provide a correction to an associated electron beam to at least partially compensate for the effect of the astigmatic magnetic deflection field on the associated beam, wherein said electrodes for forming a multipole lens include two electrodes, a first multipole lens electrode and a second multipole lens electrode, said second multipole lens electrode being connected to one of said electrodes for forming a main focusing lens, and said first multipole lens electrode being located between the second multipole lens electrode and the beam-forming region and facing the second multipole lens electrode.

2. The color display system as defined in claim 1, wherein each electrode for forming a multipole lens includes opposed sector portions of a cylinder, the opposed sector portions of one of the electrodes for forming a multipole lens being interdigitated with the opposed sector portions of the other of the electrodes for forming a multipole lens.

3. The color display system as defined in claim 1, including means for applying a dynamic signal to at least one of said electrodes for forming a multipole lens, said dynamic signal being related to deflection of the electron beams.

4. The color display system as defined in claim 3, including means for applying a second dynamic signal to at least one of said electrodes for forming a multipole lens, said second dynamic signal being related to deflection of the electron beams.

5. The color display system as defined in claim 1, wherein said multipole lens is located closer to said main focusing lens than to said beam forming region.

6. The color display system as defined in claim 2, wherein each sector portion encompasses approximately 85 degrees angle of a cylinder circumference.

7. The color display system as defined in claim 2, wherein the sector portions on one electrode forming a particular multipole lens encompass a greater angle of a cylinder than do the sector portions on the other electrode forming the particular multipole lens.

8. The color display system as defined in claim 7, wherein the sector portions on one electrode each encompass approximately 145 degrees angle of a cylinder and the sector portions on the other electrode encompass approximately 25 degrees angle of a cylinder.

9. In a color display system including a cathode-ray tube having an inline electron gun for generating and directing three electron beams along paths toward a screen of said tube, said gun including electrodes comprising a beam-forming region and electrodes for forming a main focusing lens, and said system including a self-converging yoke that produces an astigmatic magnetic deflection field, the improvement comprising electrodes in said electron gun for forming a quadrupole lens between the beam-forming region and the main focusing lens in each of the electron beam paths wherein each quadrupole lens is oriented to provide a correction to an associated electron beam to at least partially compensate for the effect of the astigmatic magnetic deflection field on the associated beam, said quadrupole lens being located closer to said main focusing lens than to said beam forming region, wherein said electrodes for forming a quadrupole lens include two electrodes, a first quadrupole lens electrode and a second quadrupole lens electrode, said second quadrupole lens electrode being connected to one of said electrodes for forming a main focusing lens, and said first quadrupole lens electrode being located between the second quadrupole lens electrode and the beam-forming region and facing the second quadrupole lens electrode, means for applying a dynamic signal to at least one of said electrodes for forming a quadrupole lens, said dynamic signal being related to deflection of the electron beams, and wherein each electrode for forming a quadrupole lens includes two opposed sector portions of a cylinder, the sector portions on one electrode being interdigitated with the sector portions on the other electrode and a quadrupole lens being formed by the interdigitated spaced sector portions.

10. In a color display system including a cathode-ray tube having an electron gun for generating and directing three electron beams along paths toward a screen of said tube, said gun including electrodes comprising a beam-forming region and electrodes for forming a main focusing lens, and said system including a self-converging yoke that produces an astigmatic magnetic deflection field, the improvement comprising electrodes in said electron gun for forming a multipole lens between the beam-forming region and the main focusing lens in each of the electron beam paths wherein each multipole lens is oriented to provide a correction to an associated electron beam to at least partially compensate for the effect of the astigmatic magnetic deflection field on the associated beam, wherein said electrodes for forming a multipole lens include two electrodes, wherein each electrode for forming a multipole lens includes opposed sector portions of a cylinder, the opposed sector portions of one of the electrodes for forming a multipole lens being interdigitated with the opposed sector portions of the other of the electrodes for forming a multipole lens.

11. The color display system as defined in claim 10, including means for applying a dynamic signal to at least one of said electrodes for forming a multipole lens, said dynamic signal being related to deflection of the electron beams.

12. The color display system as defined in claim 11, including means for applying a second dynamic signal to another of said electrodes for forming a multipole lens, said second dynamic signal being related to deflection of the electron beams.

13. The color display system as defined in claim 10, wherein each sector portion encompasses approximately 85 degrees angle of a cylinder circumference.

14. The color display system as defined in claim 10, wherein the sector portions on one electrode forming a particular multipole lens encompass a greater angle of a cylinder than do the sector portions on the other electrode forming the particular multipole lens.

15. The color display system as defined in claim 14, wherein the sector portions on one electrode each encompass approximately 145 degrees angle of a cylinder and the sector portions on the other electrode encompass approximately 25 degrees angle of a cylinder.

* * * * *